US010183779B2

(12) United States Patent
Yourist

(10) Patent No.: US 10,183,779 B2
(45) Date of Patent: Jan. 22, 2019

(54) CONTAINER FOR STORING MOTOR VEHICLE FLUID

(75) Inventor: Sheldon E. Yourist, York, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 1185 days.

(21) Appl. No.: 12/697,518

(22) Filed: Feb. 1, 2010

(65) Prior Publication Data

US 2011/0174829 A1 Jul. 21, 2011

Related U.S. Application Data

(63) Continuation-in-part of application No. 29/353,979, filed on Jan. 18, 2010, now Pat. No. Des. 653,115, and a continuation-in-part of application No. 29/353,980, filed on Jan. 18, 2010, now Pat. No. Des. 658,067.

(51) Int. Cl.

| | |
|---|---|
| ***B65D 1/00*** | (2006.01) |
| ***B65D 25/32*** | (2006.01) |
| ***B65D 1/02*** | (2006.01) |
| ***B65D 25/28*** | (2006.01) |

(52) U.S. Cl.

CPC ..... *B65D 25/32* (2013.01); *B65D 1/0223* (2013.01); *B65D 25/2897* (2013.01); *B65D 2501/0018* (2013.01)

(58) Field of Classification Search

CPC ..... B65D 1/0223; B65D 23/102; B65D 2501/0036; B65D 2501/0081

USPC ..... 215/397, 379–385; 220/669, 760, 773; D9/532, 541–543, 559, 569, 570–572

See application file for complete search history.

(56) References Cited

U.S. PATENT DOCUMENTS

| | | | | | |
|---|---|---|---|---|---|
| D1,665 | S | * | 10/1862 | Robinson | D9/560 |
| D32,027 | S | * | 12/1899 | Kronkosky | D9/563 |
| D38,221 | S | * | 9/1906 | Ridgely | D9/544 |
| D103,987 | S | * | 4/1937 | Ennever | D9/546 |
| D114,208 | S | * | 4/1939 | Dunnock | D9/570 |
| D155,595 | S | * | 10/1949 | Funkey | D9/560 |
| 3,021,973 | A | * | 2/1962 | Palmer | 215/397 |
| D192,535 | S | * | 4/1962 | Laudano | D9/543 |
| D214,239 | S | * | 5/1969 | Kemp | D9/532 |
| D217,439 | S | * | 5/1970 | Platte | D9/543 |
| D219,366 | S | * | 12/1970 | Lewis, Jr. et al. | D9/532 |
| 3,708,082 | A | * | 1/1973 | Platte | 215/385 |
| D229,670 | S | * | 12/1973 | Platte | D9/531 |
| D231,904 | S | * | 6/1974 | Boden | D9/543 |
| D238,654 | S | * | 2/1976 | Platte | D9/520 |
| 3,940,002 | A | * | 2/1976 | Schiemann | 215/383 |
| D258,117 | S | * | 2/1981 | Bashour | D9/543 |
| D262,267 | S | * | 12/1981 | Cox | D9/543 |

(Continued)

FOREIGN PATENT DOCUMENTS

EP 1930246 A1 * 6/2008 ..... B65D 1/46

*Primary Examiner* — Ernesto Grano

(74) *Attorney, Agent, or Firm* — Baker Botts L.L.P.

(57) ABSTRACT

A container for storing a fluid used in automotives is disclosed. The container has a solid filled side grip area located on a sidewall of the container. The container also uses a bail to facilitate holding of the container. A base grip area is located on the base of the container to also assist in gripping the container. The container is able to hold more oil while using less plastic, which makes the container more ecologically friendly and cost effective than existing containers.

17 Claims, 10 Drawing Sheets

(56) References Cited

U.S. PATENT DOCUMENTS 4,372,455 A * 2/1983 Cochran ..... 215/385
D277,362 S 1/1985 Epperson
D277,551 S * 2/1985 Kerr ..... D9/543
D294,120 S * 2/1988 Griesing et al. ..... D9/520
4,890,752 A * 1/1990 Ota et al. ..... 215/384
4,969,922 A * 11/1990 Platte, Sr. ..... 215/383
D320,344 S * 10/1991 Larson ..... D9/520
D329,868 S * 9/1992 Sakaguchi et al. ..... D18/43
D332,747 S * 1/1993 Darr et al. ..... D9/520
5,199,587 A * 4/1993 Ota ..... B29C 33/005 215/381
5,199,588 A * 4/1993 Hayashi ..... 215/381
5,222,615 A * 6/1993 Ota et al. ..... 215/375
D348,612 S * 7/1994 Ring ..... D9/531
D351,347 S * 10/1994 Ring ..... D9/528
5,381,910 A * 1/1995 Sugiura et al. ..... 215/398
5,499,730 A * 3/1996 Harbour ..... 215/382
D382,807 S * 8/1997 Silvers et al. ..... D9/520
D391,854 S * 3/1998 Ankney et al. ..... D9/520
D392,188 S * 3/1998 Darr et al. ..... D9/520
5,758,790 A * 6/1998 Ewing, Jr. ..... 215/384
D397,036 S * 8/1998 Katakouzinos ..... D9/520
5,833,115 A * 11/1998 Eiten ..... 220/669
D402,896 S * 12/1998 Conrad ..... D9/543
D403,243 S * 12/1998 Takeuchi et al. ..... D9/532
D409,494 S * 5/1999 Frazer ..... D9/520
D431,470 S * 10/2000 Henderson ..... D9/520
D449,538 S * 10/2001 Burleson et al. ..... D9/530
6,394,517 B1 * 5/2002 Borg ..... 294/31.2
6,527,133 B1 * 3/2003 McCollum et al. ..... 215/382
6,889,858 B2 * 5/2005 McCollum et al. ..... 215/382
D508,410 S * 8/2005 Zboch et al. ..... D9/667
D509,984 S * 9/2005 Zboch et al. ..... D9/667
6,974,047 B2 * 12/2005 Kelley et al. ..... 215/381
D515,932 S * 2/2006 Sinclair et al. ..... D9/527
7,097,059 B2 * 8/2006 Saito et al. ..... 215/383
7,097,061 B2 * 8/2006 Simpson et al. ..... 215/396
7,137,521 B2 * 11/2006 Yourist ..... 215/398
D543,466 S * 5/2007 Little et al. ..... D9/543
D543,867 S * 6/2007 Yourist ..... D9/739
D547,662 S * 7/2007 Hankins et al. ..... D9/530
D553,992 S * 10/2007 Lepoitevin ..... D9/532
7,481,325 B2 * 1/2009 Simpson et al. ..... 215/384
7,520,399 B2 * 4/2009 Lane et al. ..... 215/10
D605,952 S * 12/2009 Inoi et al. ..... D9/560
7,631,775 B2 * 12/2009 Heisner et al. ..... 215/381
D622,594 S * 8/2010 Kissinger et al. ..... D9/516
7,874,442 B2 * 1/2011 Nievierowski ..... B65D 1/0223 215/382
7,882,971 B2 * 2/2011 Kelley et al. ..... 215/373
D641,638 S * 7/2011 Stengel ..... D9/560
D653,115 S * 1/2012 Yourist ..... D9/541
D658,067 S * 4/2012 Yourist ..... D9/541
D675,101 S * 1/2013 Wilson et al. ..... D9/559
2002/0084240 A1 * 7/2002 Yu-Hsien ..... 215/258
2003/0155324 A1 * 8/2003 McCollum et al. ..... 215/382
2004/0164048 A1 * 8/2004 Yourist ..... 215/398
2005/0035084 A1 * 2/2005 Simpson et al. ..... 215/396
2005/0252881 A1 * 11/2005 Zhang et al. ..... 215/384
2006/0108317 A1 * 5/2006 Tanaka et al. ..... 215/382
2006/0151425 A1 * 7/2006 Kelley et al. ..... 215/381
2006/0249477 A1 * 11/2006 Simpson et al. ..... 215/384
2007/0045223 A1 * 3/2007 Noll et al. ..... 215/384
2007/0114200 A1 * 5/2007 Lane ..... 215/10
2007/0210028 A1 * 9/2007 Heisner et al. ..... 215/384
2007/0221606 A1 * 9/2007 Eiten et al. ..... 215/382
2008/0083696 A1 * 4/2008 Nievierowski et al. ..... 215/384
2009/0159557 A1 * 6/2009 De Vel et al. ..... 215/384
2009/0289028 A1 * 11/2009 Sasaki et al. ..... 215/384
2009/0321385 A1 * 12/2009 Oguchi et al. ..... 215/384
2010/0006535 A1 * 1/2010 Ogg ..... 215/384
2010/0072168 A1 * 3/2010 Kurihara et al. ..... 215/384

* cited by examiner

CONTAINER FOR STORING MOTOR VEHICLE FLUID

This application is a continuation in part of U.S. Design Pat. No. 29/353,979, filed on Jan. 18, 2010; this application is also a continuation in part of U.S. Design Pat. No. 29/353,980, filed on Jan. 18, 2010.

BACKGROUND OF THE INVENTION

1. Field of the Invention

The present invention is related to the field of containers. In particular the present invention relates to a container for storing fluids used with motor vehicles.

2. Description of the Related Technology

Plastic containers are used for storage due to their durability and lightweight nature. Polyolefin and Polyethylene terephthalate (PET) are used in the construction many of today's containers. Polyolefin and PET containers are lightweight, inexpensive, recyclable and manufacturable in large quantities.

Fluids used with motor vehicles, in particular oil, traditionally come packaged in a container having handle with a through hole located on one sidewall. The handle exists to permit pouring of the container contents into a receptacle located on a vehicle. The typical packaging used for oil today uses plastic in its construction however the location and formation of the handle, as well as other structural features of the typical oil container restrict the full potential that can be achieved with a plastic container in terms of storage and decreased environmental impact.

An increasing focus on having environmentally friendly containers is making the traditional type of oil container less appealing. Having a container that is able to hold more oil while using less material than traditional containers is highly desirable in a marketplace becoming sensitive to environmental impact. In addition to the environmental impact of a container, the ability of a container to limit the shelf space occupied is important in making the container desirable for stores that sell these products.

Therefore there is a need in the field to provide a container for storing motor vehicle fluid that is environmentally friendlier and more amenable to marketing concerns such as shelving space than existing containers.

SUMMARY OF THE INVENTION

An object of the present invention may be container for use with motor vehicle fluid having a bail.

Another object of the present invention may be a container for use with motor vehicle fluid having grip area located on the front and rear sidewall.

Still yet another object of the present invention may be a container for use with motor vehicle fluids having a base portion with a base grip area.

Still yet another object of the present invention may be container for use with motor vehicle fluid having grip area located on the front and rear sidewall having chamfered sidewalls.

An aspect of the present invention may be a container for use with motor vehicle fluids comprising; a top portion comprising an annular neck, wherein below the neck is an undercut and further wherein a bail is located within the undercut; a body portion located below the top portion, wherein the body portion comprises a first grip area; and a base portion located below the body portion.

Another aspect of the present invention may be a container comprising; a top portion comprising; a neck; and chamfered corner portions, wherein the chamfered corner portions slope downwardly from the neck to a chamfered transition area; a body portion comprising; a front sidewall; a rear sidewall located opposite the front sidewall; a first sidewall and a second sidewall, wherein the first sidewall is located opposite the second sidewall; and a plurality of chamfered sidewalls that extend from the chamfered transition area to a base portion; and wherein the front sidewall further comprises a first grip area and the rear sidewall further comprises a second grip area.

Still yet another aspect of the present invention may be a container for use with motor vehicle fluids comprising; a top portion comprising; an annular neck, wherein a center of the annular neck is coaxial with a longitudinal axis of the container, wherein below the neck portion is an undercut and further wherein a bail is located within the undercut; an chamfered corner portions, wherein the chamfered corner portions slope downwardly from the undercut to a chamfered transition area; a body portion comprising; a front sidewall having a first grip area; a rear sidewall having a second grip area, wherein the rear sidewall is located opposite the front sidewall; a first sidewall and a second sidewall, wherein the first sidewall is located opposite the second sidewall, and further wherein the first grip area is located closer to the first sidewall than the second sidewall and the second grip area is located closer to the first sidewall than the second sidewall; and a plurality of chamfered sidewalls that extend from the chamfered transition area to a base portion; wherein the base portion further comprises a base grip area.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
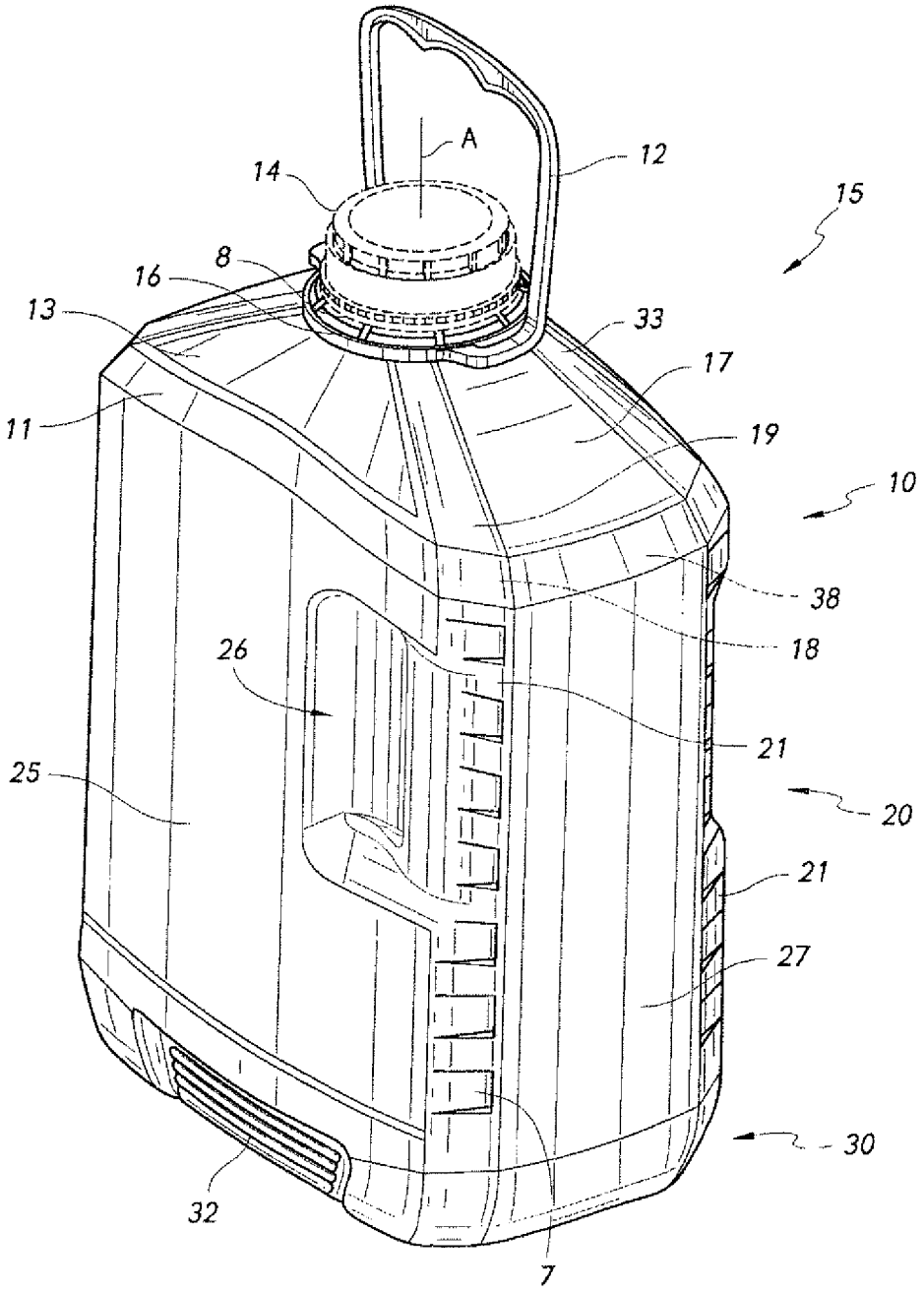
FIG. 1 is a perspective view of a container made in accordance with an embodiment of the present invention.
Figure 2:
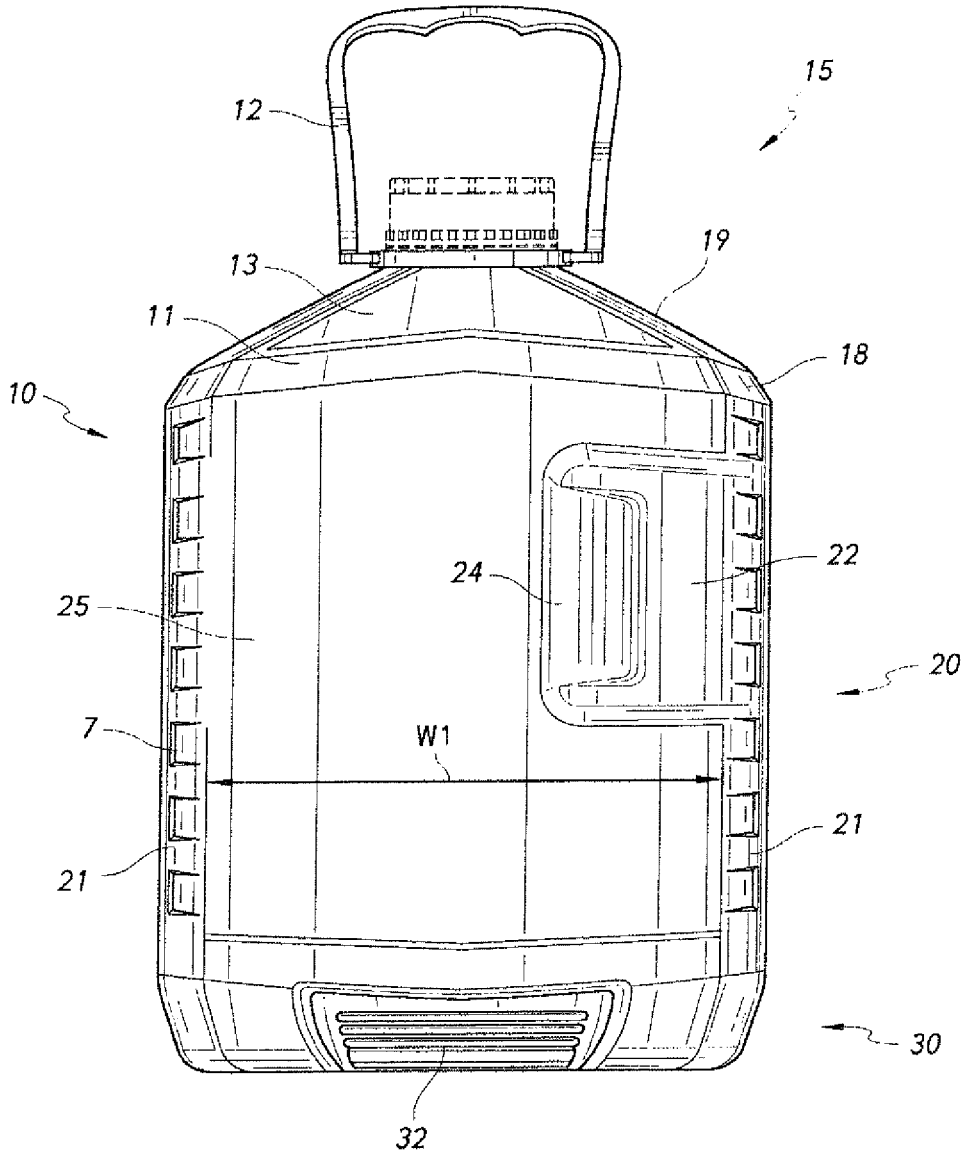
FIG. 2 is a front elevational view of the container shown in FIG. 1.
Figure 3:
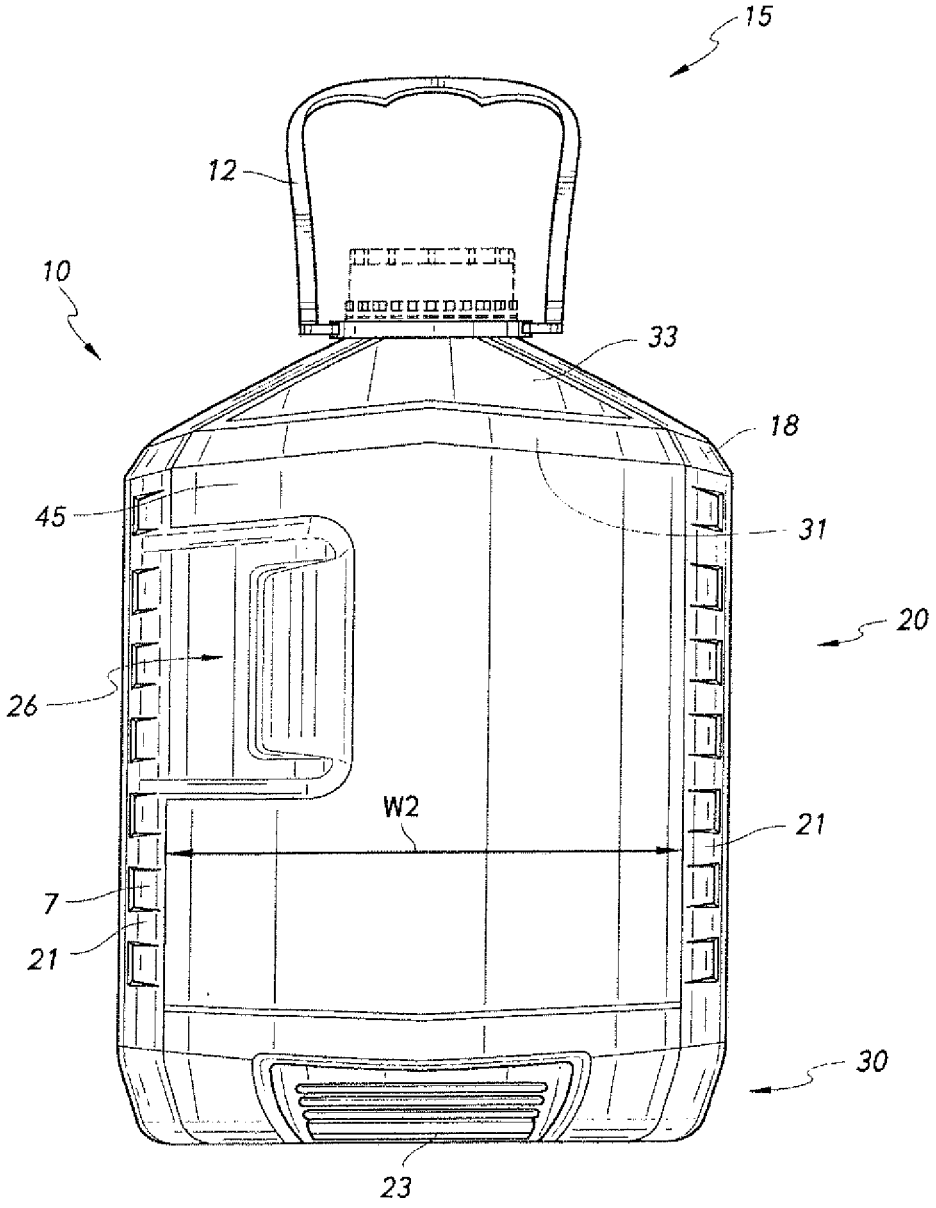
FIG. 3 is a rear elevational view of the container shown in FIG. 1.
Figure 4:
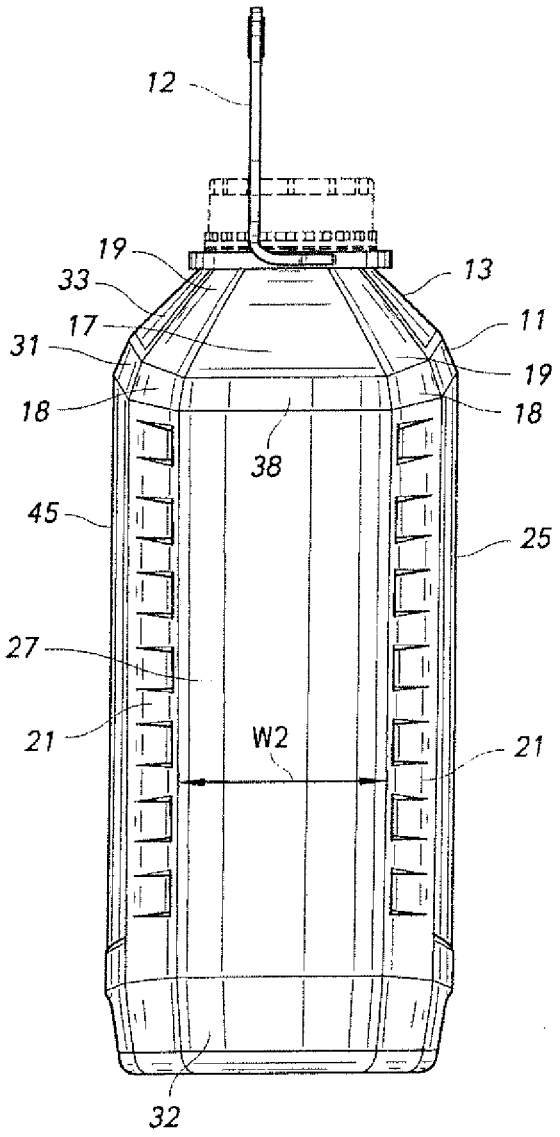
FIG. 4 is a first side elevational view of the container shown in FIG. 1.
Figure 5:
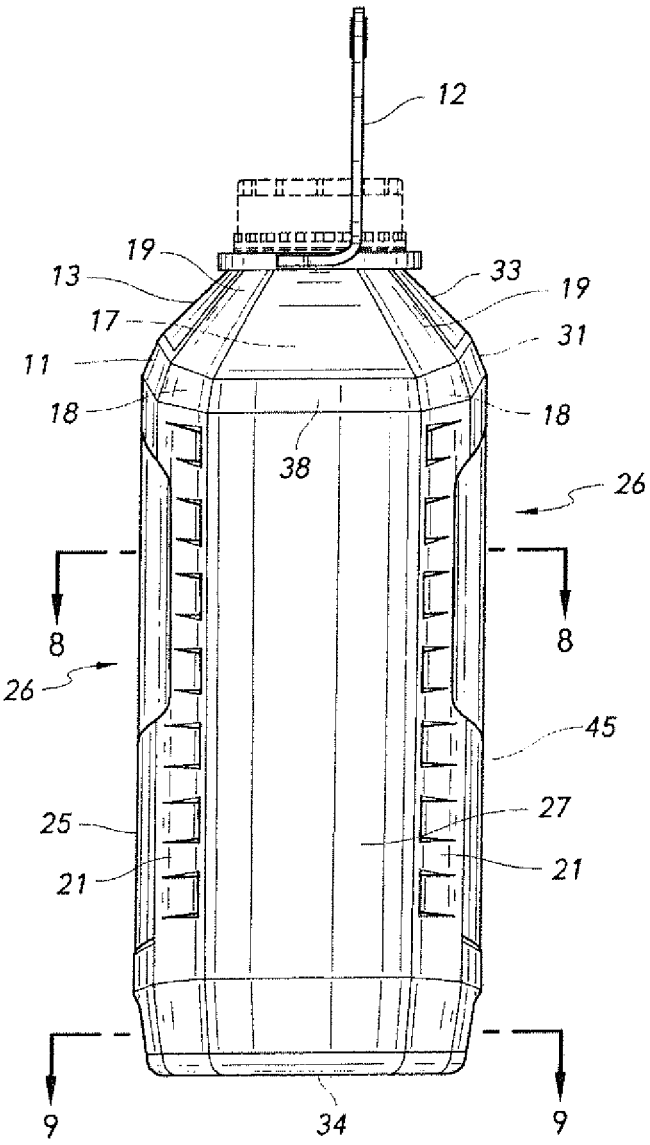
FIG. 5 is second side elevational view of the container shown in FIG. 1.
Figure 6:
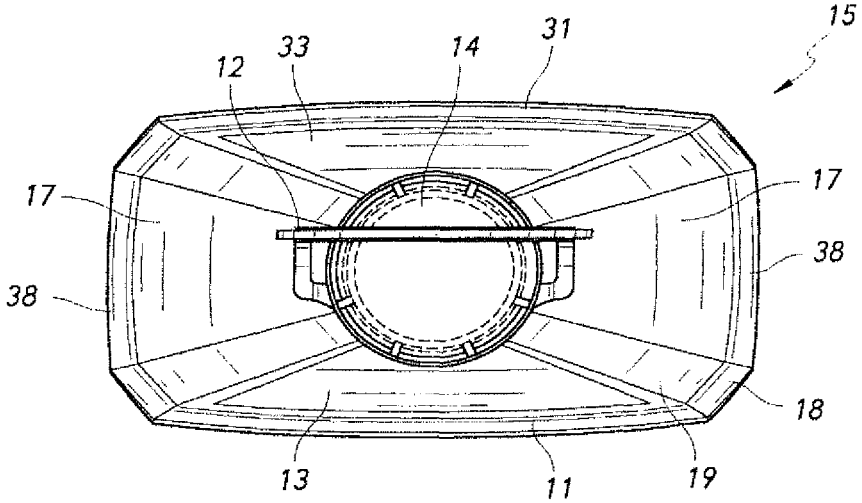
FIG. 6 is a top plan view of the container shown in FIG. 1.
Figure 7:
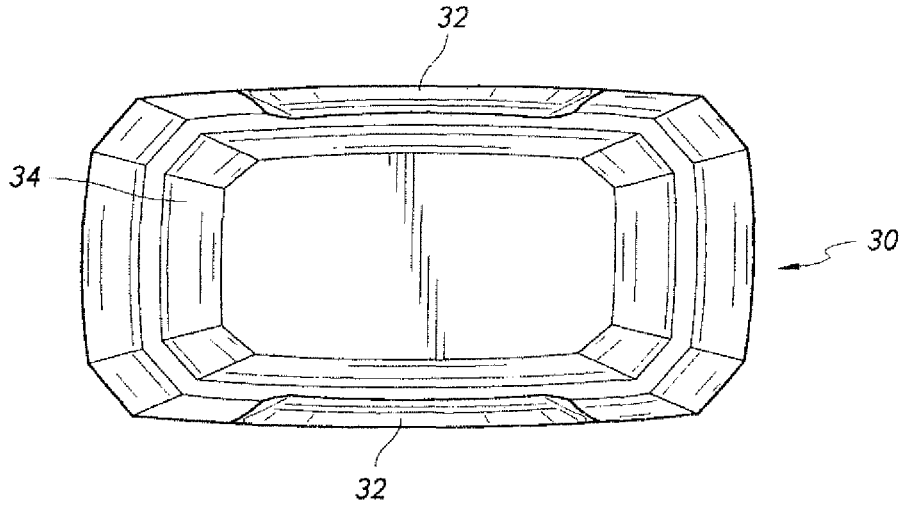
FIG. 7 is a bottom plan view of the container shown in FIG. 1.

The container 10 may have a one-piece construction and may be prepared from a monolayer plastic material, such as a polyamide, for example, nylon; a polyolefin such as polyethylene, for example, low density polyethylene (LDPE), high density polyethylene (HDPE), polypropylene, a polyester, for example, polyethylene terephthalate (PET), polyethylene naphtalate (PEN), or others, which may also include additives to vary the physical or chemical properties of the material. For example, some plastic resins may be modified to improve the oxygen permeability. Alternatively, the container may be prepared from a multilayer plastic material. The layers may be any plastic material, including virgin, recycled and reground material and may include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container is prepared from polyolefin.

Container 10 may be made by conventional blow molding processes including, for example, extrusion blow molding, stretch blow molding and injection blow molding. These molding processes are discussed briefly below.

In extrusion blow molding a molten tube of thermoplastic material, or plastic parison, is extruded between a pair of open blow mold halves. The blow mold halves close about the parison and cooperate to provide a cavity into which the parison is blown to form the container. As so formed, container 10 may include extra material, or flash, at the region where the molds come together. A moil may be intentionally present above the container finish.

After the mold halves open, the container 10 drops out and is then sent to a trimmer or cutter where any flash of moil attached to the container 10 is removed. The finished container 10 may have a visible ridge (not shown) formed where the two mold halves used to form the container came together. This ridge is often referred to as the parting line.

With stretch blow molding a pre-formed parison, or pre-form, is prepared from a thermoplastic material, typically by an injection molding process. The pre-form typically includes an opened, threaded end, which becomes the threaded member of the container 10. The pre-form is positioned between two open blow mold halves. The blow mold halves close about the pre-form and cooperate to provide a cavity into which the pre-form is blown to form the container. After molding, the mold halves open to release the container 10. For wide mouth containers, the container 10 may then be sent to a trimmer where the moil is removed.

With injection blow molding, a thermoplastic material may be extruded through a rod into an injection mold in order to form a parison. The parison is then positioned between two open blow mold halves. The blow mold halves close about the parison and cooperate to provide a cavity into which the parison may be blown to form the container 10. After molding, the mold halves open to release the container 10.

Referring now to the drawings, wherein like reference numerals refer to corresponding structure throughout and referring in particular to FIGS. 1-7, wherein views of the container 10 that is made in accordance with an embodiment of the present invention are shown.

The container 10 may be used to package fluids used with motor vehicles, for example, oil. In order to accommodate the actions that occur during the application of oil to a vehicle, the container 10 has a side grip area 26 and a base grip area 32. These two areas are designed to permit gripping of the container 10 when adding oil to an automobile. The container 10 also may have a bail 12 that facilitates the carrying of the container 10. The bail 12 is adapted to fold flat against the surface of the container 10 when desired, for example when placed on a store shelf. As shown in the figures the container 10 is designed to hold about 5 quarts of motor oil.

Older oil container designs have a heavier weight because of the presence of an off-center neck and an opening through the handle. While the opening through the handle in older container designs permits obtaining a firm grip, the creation of such a handle results in additional waste material during the construction of such a container. The container 10 incorporates a bail 12, the side grip areas 26 and the base grip areas 32 thereby eliminating the use of a through handle. Additionally, traditional oil containers use an off-center neck. The usage of an off-center neck reduces the top load capability of these types of container. The use of a center filled side grip area 26 and centrally located neck 8 allows for a more efficient top load designed structure in comparison to traditional oil containers.

Figure 11:
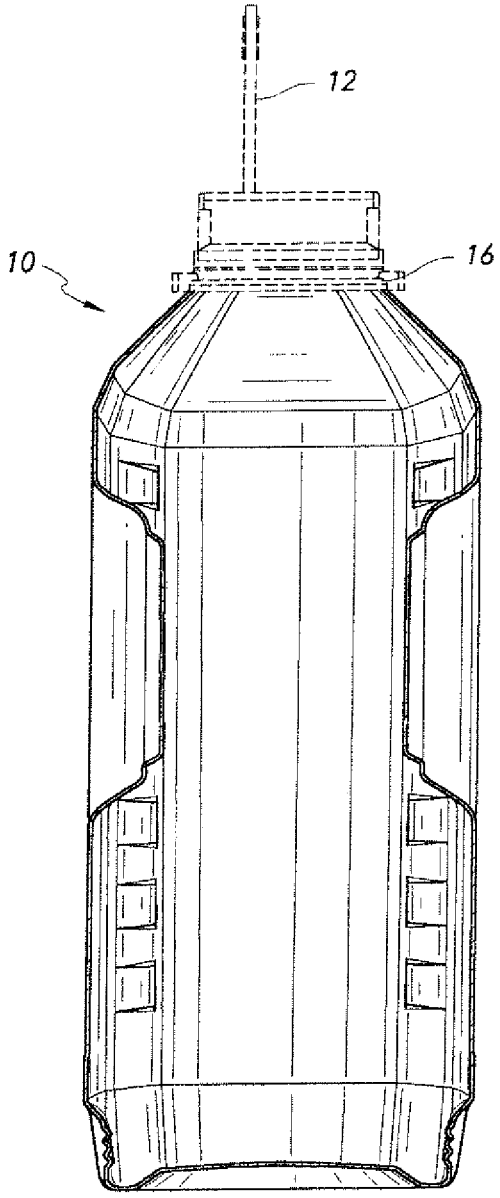
FIG. 11 shows a view of the undercut used with the handle on the container.

The container 10 is comprised of a top portion 15, a body portion 20 and a base portion 30. The top portion 15 has a cap 14 that is placed on the neck 8 of a container 10 after construction and filling in order to seal it. The neck 8 is a threaded annular shaped structure that forms the opening of the container 10. The center of the opening is co-axial with the longitudinal axis A of the container 10. Underneath the neck 8 is an undercut 16 that is adapted to accommodate the bail 12. FIG. 11 shows a view of the undercut 16 used with the bail on the container 10.

The bail 12 is placed over the cap 14 and into the undercut 16. The bail 12 may be foldable which enables it to sit flat and when stored on shelves. The bail 12 may be extended vertically along the axis A when a consumer needs to carry it.

The top portion 15 has a top front portion 13, a top rear portion 33, top side portions 17 and a chamfered top corner portion 19. As shown in the drawings, the top side portions 17 may have a width that is less than the width of the top front portion 13 or the top rear portion 33. The top side portions 17 slope downwards from the undercut 16 to the side transition area 38. The side transition areas 38 connect the top side portions 17 to the sides 27 of the container 10. The side transition areas 38 are sloped as well and slope downward from the top side portions 17 to the sidewalls 27 of the body portion 20. The slope of the side transition area 38 is steeper than the slope of the top side portion 17.

Still referring to FIGS. 1-7 and the top portion 15, the top front portion 13 slopes downward from the undercut 16 to the front transition area 11. The top rear portion 33 slopes downwards from the undercut 16 to the rear transition area 31. The top front portion 13 and the top rear portion 33 are also sloped in a horizontal direction in order to form a slight "V" shaped profile wherein the centers of top front potion 13 and the top rear portion 33 are located further from the longitudinal axis A than the portions located proximate to the chamfered top corner portions 19. The top front portion 13 and the top rear portion 33 may also be formed without being horizontally sloped.

The front transition area 11 and the rear transition area 31 slope downwardly from the top front portion 13 and the top rear portion 33 to the front sidewall 25 and the rear sidewall 45. The downward slopes of the front transition area 11 and the rear transition area 31 are steeper than the slopes of the top front portion 13 to the front transition area 11 and the top rear portion 33 to the rear transition area 31. The front transition area 11 and the rear transition area 31 are also sloped horizontally in order to form a slight "V" shaped profile wherein the centers of the front transition area 11 and the rear transition area 31 are located further from the longitudinal axis A than the portions located proximate to the chamfered transition areas 18. The front transition area 11 and the rear transition area 31 may also be formed without being horizontally sloped.

The container 10 has four top chamfered corner portions 19. The top chamfered corner portions 19 slope downward from the undercut 16 to the chamfered transition areas 18. The chamfered transition areas 18 connect the top chamfered corner portions 19 to the chamfered sidewalls 21 and slope downwardly from the top chamfered corner portion 19 to the chamfered sidewall 21. The downward slope of the chamfered transition area 18 is steeper than the slope of the top chamfered corner portions 19.

The body portion 20 comprises front sidewall 25, rear sidewall 45, chamfered sidewalls 21 and sidewalls 27. The front sidewall 25 is substantially planar and has located on the right hand portion a side grip area 26. The front sidewall 25 extends downwardly from the front transition area 11 to the base portion 30 and further extends between the chamfered sidewalls 21. The planar surface of the front sidewall 25 is directly opposed by the rear sidewall 45 on the opposite side of the container 10 and the substantially planar surfaces of each are parallel with respect to each other and the longitudinal axis.

Still referring to the body portion 20, the planar surfaces of the sidewalls 27 are directly opposed to each other and are parallel with respect to each other and the longitudinal axis. The planar surfaces of the sidewalls 27 are perpendicular with respect to the planar surfaces of the front sidewall 25 and the rear sidewall 45. The width W2 of the sidewalls 27 is less than the width W1 of the front sidewall 25 and the width W3 of the rear sidewall 45.

Figure 8:
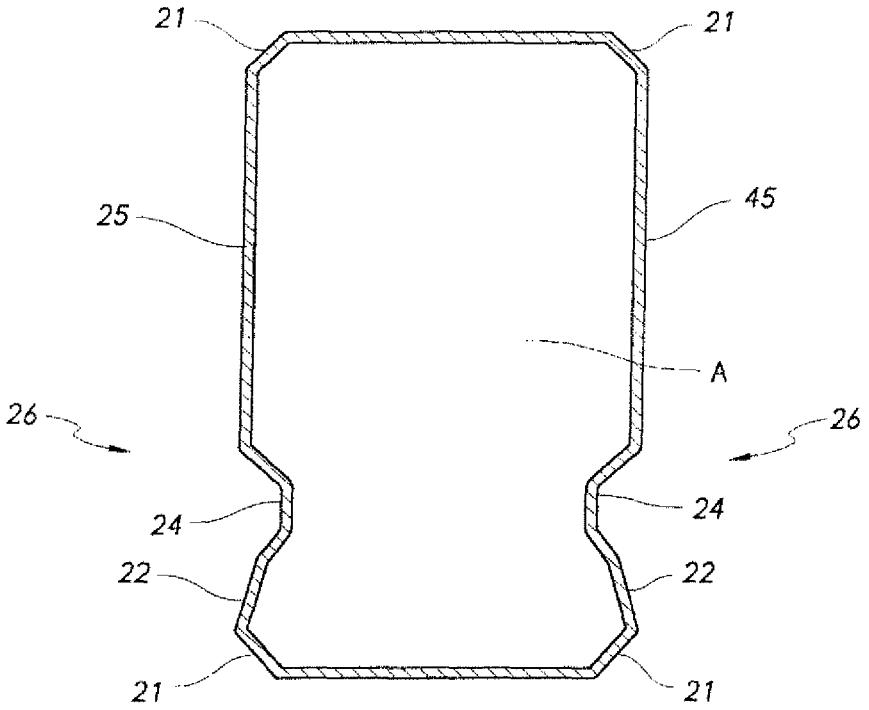
FIG. 8 is a cross-sectional view of the container shown in FIG. 1 taken along the line 8-8.

The side grip area 26 is recessed with respect to the planar surface of the front sidewall 25, which can be seen in the cross-sectional view, shown in FIG. 8. The side grip area 26 is made of a first angled side grip area 24 and a second angled side grip area 22. The second angled side grip area 22 may have a textured surface to promote firmer gripping. It should be understood that either the first angled side grip area 24 or the second angled side grip area 22 may be textured, or non-textured. Having one of the first angled side grip area 24 or the second angled side grip area 22 textured increases the ability with which one may grasp the container 10. The rear sidewall 45 is the mirror image of the front sidewall 25 with the side grip area 26 located on the left hand side of the rear sidewall 45 as opposed to the right hand side. That is to say the side grip area 26 on the front sidewall 25 is directly opposite the side grip area 26 on the rear sidewall 45.

FIG. 8 is a cross sectional view of the container 10 taken along the line 8-8. This view shows the profile taken by the side grip areas 26 in the container.

The side grip area 26 differs from existing automotive product containers in that there is no through hole located therein. The lack of a through hole permits more fluid to be stored within the container 10. Additionally, the lack of a through hole reduces the amount of waste material produced during the manufacturing process since less material is needed to be trimmed after the finished product is assembled. Overall this amounts in less plastic material used in the production of the container 10 to store similar amounts of motor vehicle fluid. For example a typical 5 quart oil container requires 185-215 grams of plastic material for its construction. The usage of the container 10 as disclosed herein reduces the overall amount of plastic used by between 20%-30% of the typical weight. So the container 10 disclosed herein may use anywhere between 140-175 grams of plastic per container in its construction. This provides significant savings in both the cost of the product and the overall impact on the environment.

The surfaces of the chamfered sidewalls 21 are substantially planar and connect the front sidewall 25, the rear sidewall 45 and the sidewalls 27. The surfaces of the chamfered sidewalls 21 are further parallel to the longitudinal axis A and form the corners of the container 10. The substantially planar surfaces of the chamfered sidewalls 21 are further angled with respect to the front sidewall 25, the rear sidewall 45 and the sidewalls 27. The orientation of the chamfered sidewalls 21 with respect to the front sidewall 25, the rear sidewall 45 and the sidewalls 27 provides increased structural integrity for the container 10 that would not be provided in their absence. The existence of the chamfered sidewalls 21 further permits non-usage of a through hole in the container 10. As shown in the drawings the chamfered sidewalls 21 have an embossed surface forming indents 7. The embossed surface is ornamental as shown, however other designs may be added or used depending on the desired aesthetic results. The embossed structure may also further increase the structural integrity.

Figure 9:
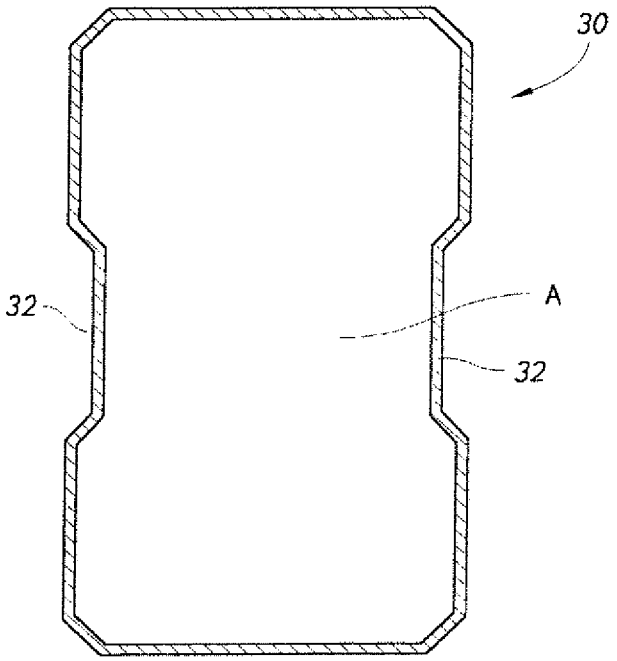
FIG. 9 is a cross-sectional view of the container shown in FIG. 1 taken along the line 9-9.

The base 30 is located below the body 20 and has a bottom 34 and base grip areas 32. The base grip areas 32 are sized so that a consumer may firmly grasp the bottom of the container 10. The base grip areas 32 may be ribbed in order to provide an additional frictional surface. Base grip areas 32 may be located on both sides of the container 10. FIG. 9 is a cross sectional view of the base 30 taken along lines 9-9. The cross-sectional view shows the base grip areas 32 recessed with respect to the rest of the base 30. The recessed base grip areas 32 permit easy gripping of the container 10.

Figure 10:
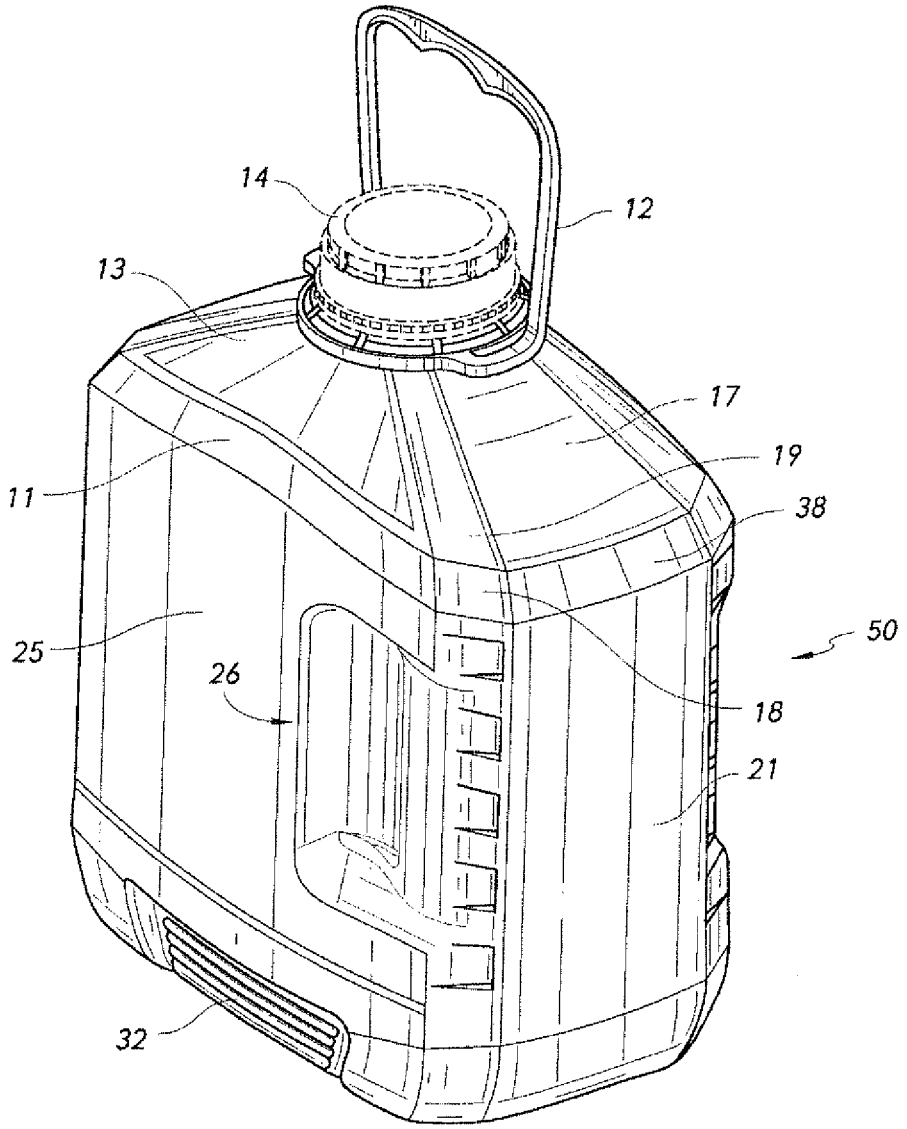
FIG. 10 is a perspective view of a container made in accordance with another embodiment of the present invention.

The container 50, shown in FIG. 10, is an alternative embodiment of the container 10 and is designed to hold 4 quarts of motor oil. The primary difference between the container 10 and the container 50 is the overall height of the containers with the container 50 appearing to have an overall squatter appearance. In the construction process the container 10 may be formed by adding an expandable base portion. Additional sizes and shapes for the container 10 may be formed through other modifications to the container 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A container for use with motor vehicle fluids comprising:

a top portion comprising an annular neck, wherein below the neck is an undercut and further wherein a bail is located within the undercut;

a body portion located below the top portion, the body portion comprising a front sidewall, a rear sidewall, a first sidewall, a second sidewall, chamfered sidewalls connecting the front and rear sidewalls to the respective first and second sidewalls to define corners of the body portion, each chamfered sidewall including a substantially planar surface, the body portion further including a first side grip area formed in the front sidewall, the first side grip area including a first angled side grip area extending inwardly from the front sidewall to a planar portion generally parallel with the front sidewall as viewed in transverse cross-section and a second angled side grip area extending directly from one of the chamfered sidewalls and inwardly of the front sidewall at an opposing angle from the first angled side grip area as viewed in transverse cross-section; and a base portion located below the body portion.

2. The container of claim 1, wherein a second side grip area is located within the rear sidewall.

3. The container of claim 2, wherein a width of the first sidewall is less than a width of the front sidewall.

4. The container of claim 3, wherein the first side grip area is located closer to the first sidewall than the second sidewall.

5. The container of claim 4, wherein the second side grip area is located closer to the first sidewall than the second sidewall.

6. The container of claim 1, wherein the first side grip area is recessed with respect to a first planar surface of the front sidewall.

7. The container of claim 1, wherein the substantially planar surface of the chamfered sidewalls includes indents formed therein.

8. The container of claim 1, wherein the top portion further comprises chamfered corner portions, wherein the chamfered corner portions slope downwardly from the undercut toward respective chamfered sidewalls.

9. The container of claim 1, wherein the base portion further comprises a base grip area on the front sidewall proximate the base portion.

10. A container for use with motor vehicle fluids comprising:

a top portion comprising:

an annular neck, wherein a center of the annular neck is coaxial with a longitudinal axis of the container, wherein below the neck is an undercut and further wherein a bail is located within the undercut; and top-chamfered corner portions, wherein each top-chamfered corner portion slopes downwardly from the undercut to a chamfered transition area;

a body portion comprising:

a plurality of chamfered sidewalls to define corners of the body portion, the chamfered sidewalls extending between the chamfered transition areas and a base portion;

wherein the base portion further comprises a base grip area;

a front sidewall having a first side grip area and a rear sidewall having a second side grip area, wherein the rear sidewall is located opposite the front sidewall, each side grip area including a first angled side grip area extending inwardly from the front sidewall and the rear sidewall, respectively, to a planar portion as viewed in transverse cross-section and a second angled side grip area extending directly from one of the chamfered sidewalls and inwardly of the front sidewall and the rear sidewall, respectively, at an opposing angle from the first angled side grip area as viewed in transverse cross-section, wherein the planar portion of the first side grip area is parallel to the planar portion of the second side grip area; and a first sidewall and a second sidewall, wherein the first sidewall is located opposite the second sidewall, and further wherein the first side grip area is located closer to the first sidewall than the second sidewall and the second side grip area is located closer to the first sidewall than the second sidewall.

11. A container for use with motor vehicle fluids comprising:

a top portion comprising an annular neck, wherein below the neck is an undercut and further wherein a bail is located within the undercut;

a body portion located below the top portion, the body portion comprising a front sidewall, a rear sidewall, a first sidewall, a second sidewall, chamfered sidewalls connecting the front and rear sidewalls to the respective first and second sidewalls to define corners of the body portion, each chamfered sidewall including a substantially planar surface, the body portion further including a first side grip area formed in the front sidewall and a second side grip area formed in the rear sidewall, the each side grip area including a first angled side grip area extending inwardly from the front sidewall and the rear sidewall, respectively, to a planar portion as viewed in transverse cross-section and a second angled side grip area extending directly from one of the chamfered sidewalls and inwardly of the front sidewall and the rear sidewall, respectively, at an opposing angle from the first angled side grip area as viewed in transverse cross-section, wherein the planar portion of the first side grip area is parallel to the planar portion of the second side grip area; and a base portion located below the body portion.

12. The container of claim 11, wherein the container is made of between 140-175 grams of material.

13. The container of claim 11, wherein the base portion comprises a plurality of grip areas.

14. The container of claim 11, wherein the top portion further comprises a top front portion and a top rear portion, wherein the top front portion and the top rear portion are each sloped to form a V-shaped profile.

15. The container of claim 14, wherein the top portion includes top-chamfered corner portions.

16. The container of claim 11, wherein the first side grip area is located closer to the first sidewall than the second sidewall.

17. The container of claim 16, wherein the first side grip area is recessed with respect to a first planar surface of the front sidewall.

* * * * *